US007753172B2

(12) United States Patent
Munson

(10) Patent No.: US 7,753,172 B2
(45) Date of Patent: Jul. 13, 2010

(54) LUBRICANT SUMP WITH METAL FOAM DIFFUSER

(75) Inventor: John H. Munson, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 476 days.

(21) Appl. No.: 11/674,251

(22) Filed: Feb. 13, 2007

(65) Prior Publication Data

US 2008/0190700 A1 Aug. 14, 2008

(51) Int. Cl.
*F01D 25/18* (2006.01)
*F01M 1/00* (2006.01)

(52) U.S. Cl. ..... 184/6.11; 184/11.1; 184/6.17

(58) Field of Classification Search ..... 184/6.11, 184/11.1; 55/184, 400, 401, 406, 409, 525; 244/130; 165/185
See application file for complete search history.

(56) References Cited

U.S. PATENT DOCUMENTS 3,912,464 A * 10/1975 Schulz ..... 48/95
4,049,401 A 9/1977 Smith
4,422,821 A 12/1983 Smith
4,576,001 A 3/1986 Smith
4,714,139 A * 12/1987 Lorenz et al. ..... 184/6.11
4,840,645 A * 6/1989 Woodworth et al. ..... 95/270
5,542,402 A 8/1996 Lee et al.
5,679,041 A 10/1997 Sokol et al.
6,196,307 B1 * 3/2001 Ozmat ..... 165/185
6,197,251 B1 3/2001 Hashimoto et al.
6,398,833 B1 6/2002 Santerre et al.
6,767,663 B2 7/2004 Li et al.
6,893,478 B2 5/2005 Care et al.
7,048,230 B2 * 5/2006 Meyer ..... 244/130
2006/0231337 A1 * 10/2006 Vogeltanz ..... 184/6

OTHER PUBLICATIONS

Lawrence W. Scott and Arthur J. Hudson, Performance of RETIMET Metal Foam Vents on Explosion-Proof Enclosures, 1992, Bureau of Mines, Report of Investigations RI 9410, p. 8.*

* cited by examiner

*Primary Examiner*—John Q Nguyen
*Assistant Examiner*—Robert T Reese
(74) *Attorney, Agent, or Firm*—Meiers Law Office

(57) ABSTRACT

A lubrication scavenge system is disclosed herein. The lubrication scavenge system includes a structure disposed for high-speed rotation about an axis. The lubrication scavenge system also includes a sump housing with an inwardly-facing surface substantially encircling the structure for receiving and directing lubricant expelled from the structure. A volume is defined between the structure and the inwardly-facing surface. The lubrication scavenge system also includes an open cell metal foam body disposed in the volume and tightly encircling the structure to substantially reduce windage.

20 Claims, 2 Drawing Sheets

LUBRICANT SUMP WITH METAL FOAM DIFFUSER

BACKGROUND OF THE INVENTION

1. Field of the Invention

The invention relates to an arrangement for scavenging lubricant from a structure rotating at relatively high speed such as, for example, a shaft or bearing or gear of a turbine engine.

2. Description of Related Prior Art

Structures rotating at relatively high speeds are found in many operating environments including, for example, turbine engines for aircraft and for power generation, turbochargers, superchargers, and some reciprocating engines. The rotating structures in these operating environments are often supported by lubricated components such as bearings. Other components in these environments can also receive lubricant, including seal runners and gears. A stationary structure, such as a sump, is often disposed to surround the lubricated component to collect the lubricant expelled from the lubricated component. The performance and life of lubricated components can be enhanced if the expelled lubricant is removed from the sump relatively quickly. If the expelled lubricant resides in the sump for an extended period of time, the lubricant may be undesirably churned and rapidly overheated. In many conventional lubrication systems, lubricant is supplied to the lubricated components under pressure and then drains from the sump in response to gravity. Lubricant flow away from lubricated components can be complicated in airborne applications since the attitude of the lubricated components can change and negate the effects of gravity as predictor of oil flow movement.

SUMMARY OF THE INVENTION

A lubrication scavenge system is provided by the present invention. The lubrication scavenge system includes a structure disposed for high-speed rotation about an axis. The lubrication scavenge system also includes a sump housing with an inwardly-facing surface substantially encircling the structure for receiving and directing lubricant expelled from the structure. A volume is defined between the structure and the inwardly-facing surface. The lubrication scavenge system also includes an open cell metal foam body disposed in the volume and tightly encircling the structure to substantially reduce windage.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
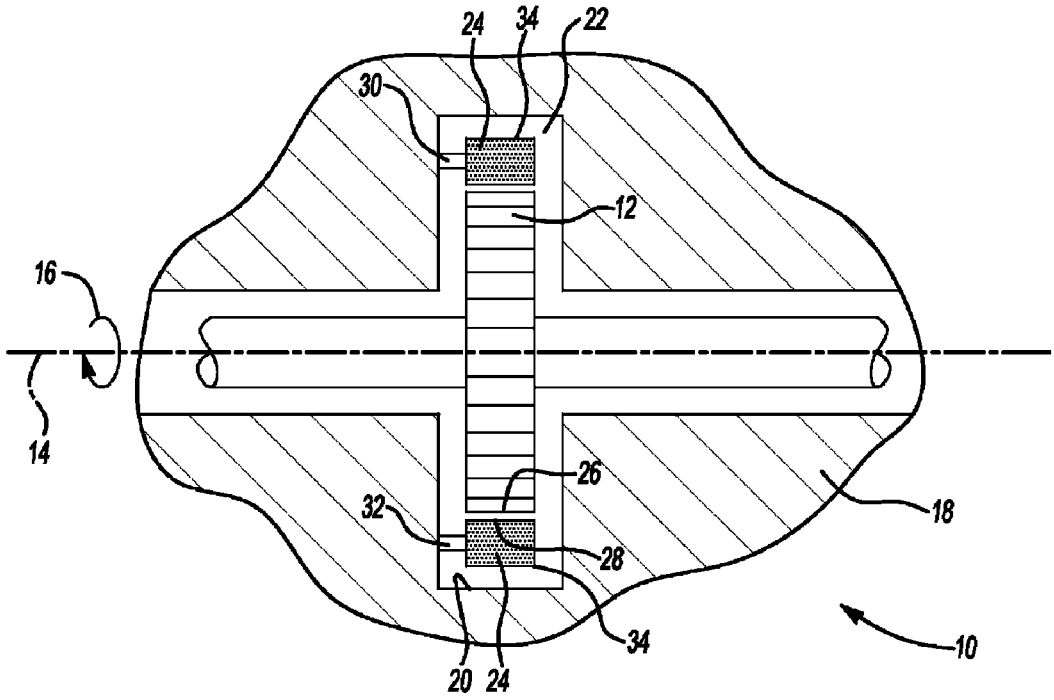
FIG. 1 is a simplified schematic diagram of a first exemplary embodiment of the invention.

A plurality of different embodiments of the invention are shown in the Figures of the application. Similar features are shown in the various embodiments of the invention. Similar features have been numbered with a common reference numeral and have been differentiated by an alphabetic designation. Also, to enhance consistency, features in any particular drawing share the same alphabetic designation even if the feature is shown in less than all embodiments. Similar features are structured similarly, operate similarly, and/or have the same function unless otherwise indicated by the drawings or this specification. Furthermore, particular features of one embodiment can replace corresponding features in another embodiment unless otherwise indicated by the drawings or this specification.

Figure 2:
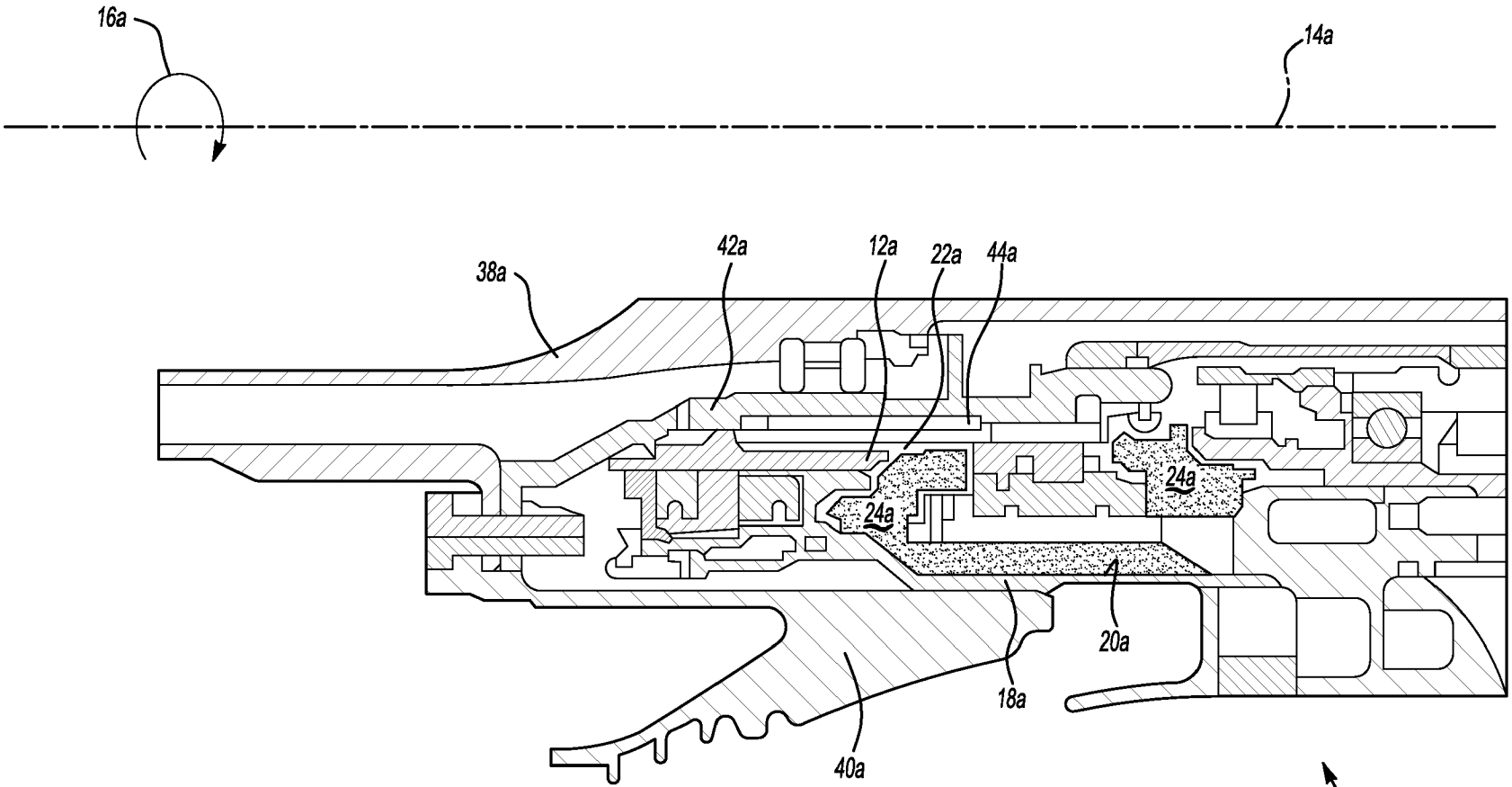
FIG. 2 is a cross-sectional view taken along an axis of rotation of a second exemplary embodiment of the invention.

FIGS. 1 and 2 shows a simplified arrangement according to a first exemplary embodiment of the invention. In the first exemplary embodiment of the invention, a lubrication scavenge system 10 for high-speed rotation applications includes a structure 12 disposed for high-speed rotation about an axis 14 in a direction of arrow 16. The structure 12 of the first exemplary embodiment is a gear. Alternative embodiments of the invention can include a structure other than a gear rotating at high-speed, such as a bearing, a sleeve, a shaft, or any other structure known to those skilled in the art to be rotatable. The structure 12 is subjected to lubrication. During rotation, lubricant is expelled from the structure 12 in centrifugal direction.

The lubrication scavenge system 10 also includes a sump housing 18 with an inwardly-facing surface 20 substantially encircling the structure 12. The sump housing 18 can surround the structure 360° or less than 360°. The sump housing 18 receives and directs the lubricant expelled from the structure 12. A volume 22 is defined between the structure 12 and the inwardly-facing surface 20. The inwardly-facing surface 20 may take any configuration, such as a substantially cylindrical surface or a box-like surface or an irregular surface.

The lubrication scavenge system 10 also includes an open cell metal foam body 24 disposed in the volume 22 and tightly encircling the structure 12. The body 24 is spaced from the structure 12 to allow the structure 12 to freely rotate, but is disposed as close to the structure 12 as possible in the exemplary embodiment of the invention to minimize windage. The cells of the open cell metal foam body 24 define several paths of movement for lubricant expelled from the structure 12. Lubricant can pass through the matrix defined by the open cells of the metal foam body 24 to move away from the structure 12. One or more of the paths can be torturous and/or one or more of the paths can be straight based on the trajectory of any particular drop of lubricant.

The open cell metal foam body 24 defines a plurality of paths of movement for the expelled lubricant and also reduces the likelihood of windage being generated by the structure 12 during rotation. Windage is the velocity profile of air disposed between a rotating body and a stationary body. The air is urged in motion by rotation of the rotating body. The flow field of the windage extends radially outward from the radially outermost surface the rotating body to the radially innermost surface of the stationary body. The velocity profile can be determined by solving standard turbulent flow equations in either closed form or by using commercial CFD software.

The open cell metal foam body 24 reduces the likelihood of windage being generated because the open cell metal foam body 24 tightly encircles the structure 12. The windage flow field would theoretically be generated between a outer radial periphery 26 of the structure 12 and an inner radial periphery 28 of the open cell metal foam body 24. However, the distance between the peripheries 26, 28 is minimized to substantially reduce the likelihood of windage.

The open cell metal foam body 24 is fixed to the sump housing 18 with brackets 30, 32 in the first exemplary embodiment of the invention. The open cell metal foam body 24 can be formed in any shape to conform to the shape of the volume between the outer radial periphery 26 of the rotating structure 12 and the shape of the sump housing 18. The open cell metal foam body 24 can be formed by molding directly into the desired shape or can be molded into a generic form and then machined.

The open cell metal foam body 24 can be formed to have relatively large cells or small cells. In one embodiment of the invention, the open cell metal foam body 24 can be 90%-95% air by volume. In any particular operating environment, the size of the cells can be selected to enhance lubricant flow and/or retard windage penetration in the matrix defined by the cells. For example, a metal foam body 24 having relatively larger cells may yield more desirable results in an operating environment wherein the rotation of the structure is relatively high. Relatively larger cells can provide larger openings and pathways for lubricant passage. At the same time, windage driven at relatively high speed can be less likely deviate from a circular path and into a opening that is tangential to the direction of flow. Alternatively, a metal foam body 24 having relatively smaller cells may yield more desirable results in an operating environment wherein the rotation of the structure is relatively high. It should be appreciated that flow dynamics in a sump are extremely complex. Conditions in each operating environment are unique and the selection of cell size can be made in view of numerous factors.

The open cell metal foam body 24 can be formed with any foam metal forming processes including bubbling gas through molten aluminum and aluminum alloys; stirring a foaming agent into a molten alloy and controlling pressure while cooling; consolidating metal powder with a foaming agent and heating to a state between fully solid and fully liquid; vapor phase deposition of metal onto a polymer foam precursor that is subsequently burned out; trapping high-pressure inert gar in pores by powder hot isostatic pressing followed by expansion of the gas at elevated temperatures; or any other method.

In the first exemplary embodiment of the invention, the open cell metal foam body 24 is spaced radially inward from the inwardly-facing surface 20. This positioning of the open cell metal foam body 24 enhances the flow of lubricant. For example, the lubricant can move through the open cell metal body 24 to be shielded from the effects of windage. However, after moving a distance through the metal foam body 24 away from the rotating structure 12, protection from windage becomes unnecessary. It can then be desirable to define a relatively smooth, straight path for the lubricant to travel after protection from windage has been achieved. One or more of the paths through the metal foam body 24 can be torturous. Thus, spacing the metal foam body 24 from the inwardly-facing surface 20 allows the lubricant to drip from metal foam body 24 to the inwardly-facing surface 20 and then travel along the relatively smooth inwardly-facing surface 20 to a drain. The inwardly-facing surface 20 can be shaped with depressions, grooves, channels, etc., to enhance movement of the lubricant that has passed through the metal foam body 24.

The open cell metal foam body 24 of the first exemplary embodiment of the invention has a variable density. The open cell metal foam body 24 can define a first density at the inner radial periphery 28, adjacent to the structure 12, and a second density at an outer radial periphery 34, adjacent the inwardly-facing surface 20. The first density is greater than the second density.

Figure 3:
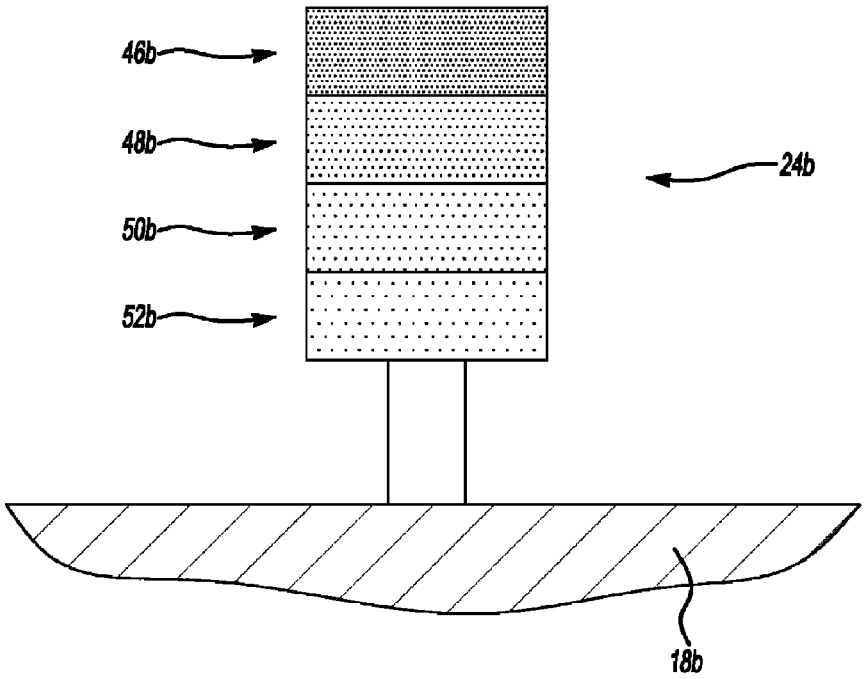
FIG. 3 is a partial cross-sectional view taken along an axis of rotation of a third exemplary embodiment of the invention.

As shown in FIG. 3, one-half of a body 24*b* is shown having several discrete portions 46*b*, 48*b*, 50*b*, 52*b* defining different densities. The body 24*b* is disposed in a sump 18*b*. The density of the portion 46*b* is greater than the density of the portion 48*b*; the density of the portion 48*b* is greater than the density of the portion 50*b*; and the density of the portion 50*b* is greater than the density of the portion 52*b*. The discrete portions 46*b*, 48*b*, 50*b*, 52*b* can be formed as several discrete body portions engaged to one another to form the body 24*b*. The exemplary discrete portions 46*b*, 48*b*, 50*b*, 52*b* are concentric with respect to one another.

In alternative embodiments of the invention, the distribution of portions having different densities can be non-linear. In other words, the arrangement of the portions need not extend from highest density portion to lowest density portion or from lowest density portion to highest density portion. For example, in an alternative embodiment of the invention, the order of the portions with respect to density can be a "high" density portion, a "low" density portion, a "highest" density portion, and a "lowest" density portion. Also, alternative embodiments of the invention can include gaps between portions having different densities or between portions having the same density.

At the inner radial periphery 28 it can be desirable to have relatively smaller openings to the cells to reduce the likelihood of any windage from passing into the open cell metal body 24. At the outer radial periphery 34 it can be desirable to have relatively larger openings to the cells to reduce the resistance to lubricant movement out of the metal foam body 24. Alternatively, it can be opposite to the arrangement described immediately above. The metal foam body 24 can have relatively larger cells at the inner radial periphery 28 and smaller cells at the outer radial periphery 34. As set forth above, conditions in each operating environment are unique and the selection of cell size can be made in view of numerous factors.

In operation, at least one drop of lubricant can be expelled into the open cell metal foam body 24 in a direction that is opposite to gravity. This expelled drop of lubricant may move in the metal foam body 24 in a first direction away from the structure 12, travel a distance until momentum is lost, travel back toward the rotating structure 12 due to gravity, drip back onto the structure 12, and finally be expelled a second time. This drop of lubricant will ultimately be expelled in a direction that is not fully opposite to gravity and will then pass through the metal foam body 24 to the inwardly-facing surface 20.

FIG. 2 is a more detailed drawing than FIG. 1 and shows a second exemplary embodiment of the invention in the form of a portion of a turbine engine 36*a* with the aft end of the engine 36*a* to the left and the forward end of the engine 36*a* to the right. In the second exemplary embodiment of the invention, a lubrication scavenge system 10*a* for high-speed rotation applications includes a structure 12*a* disposed for high-speed rotation about an axis 14*a* in a direction defined by arrow 16*a*. The structure 12*a* of the second exemplary embodiment is a seal runner. Alternative embodiments of the invention could include a structure rotating at high-speed other than a lip seal, such as a bearing, a sleeve, a shaft, or any other structure or combination of structures rotating together. The turbine engine 36*a* can include several components that rotate together, such as the combination of a primary shaft 38*a*, a first stage shaft 40*a*, a compressor stub shaft 42*a*, and a bearing spacer 44*a*. Portions of this rotating structure are supported by a bearings having inner races that also rotate at high speed. The structure 12*a* is subjected to lubrication. During rotation, lubricant is expelled from the structure 12*a* due to centripetal force.

The lubrication scavenge system 10*a* also includes a sump housing 18*a* with an inwardly-facing surface 20*a* substantially encircling the structure. The sump housing 18*a* receives and directs the lubricant expelled from the structure 12*a*. A volume 22*a* is defined between the structure 12*a* and the inwardly-facing surface 20*a*. The lubrication scavenge system 10*a* also includes an open cell metal foam body 24*a* disposed in the volume 22*a* and tightly encircling the structure 12*a*. The open cell metal foam body 24*a* defines a path of movement for lubricant expelled from the structure 12*a* and also reduces the likelihood of windage being generated by the structure 12*a* during rotation.

One difference between the second exemplary open cell metal foam body 24*a* and the first exemplary open cell metal foam body 24 is that the second exemplary open cell metal foam body 24*a* substantially fills the volume 22*a*, extending to the inwardly-facing surfaces 20*a*. This arrangement can be desirable in that mounting fixtures such as the brackets 30, 32 in the first exemplary embodiment are not required. Another difference is that the second exemplary open cell metal foam body 24*a* is defined by more complicated geometry than the first exemplary open cell metal foam body 24. A metal foam body 24 defined by more complicated geometry may be necessary in some operating environments.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A lubrication scavenge system comprising:

a structure disposed for high-speed rotation about an axis;

a stationary sump housing with an inwardly-facing surface substantially encircling said structure for receiving and directing lubricant expelled from said structure wherein a volume is defined between said structure and said inwardly-facing surface; and a non-rotatable open cell metal foam body disposed in said volume and tightly encircling said structure and be spaced from said structure to substantially reduce windage generated by said structure and extending in a flow field radially outward from a radially outermost surface of said structure.

2. The lubrication scavenge system of claim 1 wherein said open cell metal foam body is further defined as substantially filling said volume.

3. The lubrication scavenge system of claim 1 wherein said open cell metal foam body is further defined as extending a length along said axis and being spaced radially inward from said inwardly-facing surface along a majority of said length.

4. The lubrication scavenge system of claim 1 wherein said open cell metal foam body is further defined as being between 90% and 95% air by volume.

5. The lubrication scavenge system of claim 1 wherein said open cell metal foam body is further defined as having a variable density, with at least two portions of different density wherein the lubricant expelled from said structure passes through both of said at least two portions.

6. The lubrication scavenge system of claim 1 wherein said open cell metal foam body is further defined as having a first density adjacent to said structure and a second density adjacent said inwardly-facing surface wherein said first density is greater than said second density such that the lubricant expelled from said structure first passes through a relatively higher density portion of said open cell metal foam body and then a relatively lower density portion of said open cell metal foam body.

7. The lubrication scavenge system of claim 5 wherein said open cell metal foam body is further defined as having several discrete portions defining different densities.

8. The lubrication scavenge system of claim 1 wherein said open cell metal foam body is further defined as being one-piece.

9. The lubrication scavenge system of claim 1 wherein said open cell metal foam body is further defined as having a plurality of discrete portions engaged with one another.

10. The lubrication scavenge system of claim 9 wherein said plurality of discrete portions are further defined as being concentric with respect to one another.

11. A method for lubricating a rotating structure and scavenging lubricant expelled from the structure comprising the steps of:

directing lubricant to a structure disposed for high-speed rotation about an axis;

encircling the structure with a stationary sump housing having an inwardly-facing surface to receive and direct expelled lubricant; and minimizing windage generated by the structure and extending in a flow field radially outward from a radially outermost surface of said structure by tightly encircling the structure with a non-rotatable open cell metal foam body disposed in the sump housing and spaced from said structure.

12. The method of claim 11 further comprising the step of:

filling a volume defined between the structure and the sump housing with the open cell metal foam body.

13. The method of claim 11 further comprising the step of:

spacing the open cell metal foam body radially inward from the inwardly-facing surface at least partially along the axis.

14. The method of claim 11 further comprising the step of:

varying the density of the open cell metal foam body in a centrifugal direction away from the axis.

15. An apparatus for minimizing windage generated by rotating structures and collecting lubricant expelled from the rotating structures comprising:

a stationary sump housing with an inwardly-facing surface operable to substantially encircle a structure rotating at high speed; and a non-rotatable open cell metal foam body disposed within the sump housing and spaced radially inward from said inwardly-facing surface and radially spaced from the rotating structure wherein the open cell metal foam body concurrently defines at least one path of movement for lubricant between the structure and the inwardly-facing surface and also substantially minimizes windage generated by the structure and extending in a flow field radially outward from a radially outermost surface of said structure during rotation the non-rotatable open cell metal foam body tightly encircling said rotating structure.

16. The apparatus of claim 15 wherein said open cell metal foam body is further defined as having a variable density in the radial direction in which lubricant is expelled.

17. The lubrication scavenge system of claim 15 wherein said open cell metal foam body is further defined as having a first density adjacent to said structure and a second density adjacent said inwardly-facing surface wherein said first density is less than said second density such the density of said open cell foam body decreases as the lubricant moves radially outward from said rotating structure.

18. The lubrication scavenge system of claim 16 wherein said open cell metal foam body is further defined as having several discrete portions defining different densities.

19. The lubrication scavenge system of claim 15 wherein said open cell metal foam body is further defined as having a plurality of discrete portions engaged with one another.

20. The lubrication scavenge system of claim 19 wherein said plurality of discrete portions are further defined as being concentric and encircling one another.

* * * * *